US011400963B2

(12) United States Patent
Bartek et al.

(10) Patent No.: US 11,400,963 B2
(45) Date of Patent: Aug. 2, 2022

(54) DERAIL WARNING LIGHT SYSTEM

(71) Applicant: Focused Technology Solutions, Inc., Rockaway, NJ (US)

(72) Inventors: Peter M. Bartek, Ledgewood, NJ (US); Timothy J. Benjamin, Newnan, GA (US); Corey Dash, Mount Arlington, NJ (US); Philip Anthony Mooney, Gibbons (CA); Jason Neil Smith, Edmonton (CA)

(73) Assignee: Focused Technology Solutions, Inc., Hackettstown, NJ (US)

( * ) Notice: Subject to any disclaimer, the term of this patent is extended or adjusted under 35 U.S.C. 154(b) by 226 days.

(21) Appl. No.: 16/554,776

(22) Filed: Aug. 29, 2019

(65) Prior Publication Data

US 2020/0070856 A1 Mar. 5, 2020

Related U.S. Application Data

(60) Provisional application No. 62/727,366, filed on Sep. 5, 2018.

(51) Int. Cl.
*B61L 23/00* (2006.01)

(52) U.S. Cl.
CPC ..... *B61L 23/00* (2013.01)

(58) Field of Classification Search
CPC ..... B61K 5/06; B61K 7/20; B61L 5/1809; B61L 5/189; B61L 23/00; B61L 2207/02; B61L 9/00
See application file for complete search history.

(56) References Cited

U.S. PATENT DOCUMENTS 2,475,578 A * 7/1949 Halstead ..... B61L 23/00 455/79
3,544,960 A * 12/1970 Hayes ..... B61L 7/081 246/473 R
5,791,605 A * 8/1998 Howie, II ..... B61L 5/125 116/63 P (Continued)

FOREIGN PATENT DOCUMENTS

CN 2093128 U * 1/1992
CN 201547535 U * 8/2010

(Continued)

OTHER PUBLICATIONS

CN 107075878 (English translation) (Year: 2017).*

(Continued)

*Primary Examiner* — Mark T Le
(74) *Attorney, Agent, or Firm* — Arnold & Porter Kaye Scholer

(57) ABSTRACT

The derail warning system may include a solar-powered LED indicator for derail or switch. The derail warning system may also include an orientation sensor that automatically turns on depending on the orientation of the derail (up or down), derail metal flag, or switch indicator flag. The derail warning system may bring more visibility with a 360-degree LED that is solar powered and may detect orientation and turn on based on the position of the derail, switch, or flag. The derail warning system may use a unique acceleration sensor or g-sensor that can detect orientation movement and automatically turn on or off and be fully charged to operate day or night. The derail warning system may also include a data-logging microprocessor to determine a time stamp of position and location.

20 Claims, 13 Drawing Sheets

(56) References Cited

U.S. PATENT DOCUMENTS

| | | | | |
|---|---|---|---|---|
| 5,859,693 | A * | 1/1999 | Dunne | G01C 15/002 356/4.01 |
| 8,529,107 | B2 | 9/2013 | Moran et al. | |
| 9,981,676 | B2 | 5/2018 | Sandstrom | |
| 2008/0023592 | A1* | 1/2008 | Hertel | B61K 5/06 246/163 |
| 2013/0015298 | A1 | 1/2013 | Cooper et al. | |
| 2017/0018166 | A1* | 1/2017 | Johnson | G08B 13/08 |
| 2017/0217456 | A1* | 8/2017 | McCarthy | B61L 5/189 |
| 2018/0009453 | A1 | 1/2018 | Eckl et al. | |

FOREIGN PATENT DOCUMENTS

| | | | | | |
|---|---|---|---|---|---|
| CN | 102173299 | A | | 9/2011 | |
| CN | 203601307 | U | | 5/2014 | |
| CN | 204548151 | U | | 8/2015 | |
| CN | 106828533 | A | | 6/2017 | |
| CN | 107075878 | A | * | 8/2017 | E05B 35/105 |
| GB | 2260397 | A | * | 4/1993 | B60Q 1/2611 |
| GB | 2288659 | A | * | 10/1995 | B60Q 7/00 |

OTHER PUBLICATIONS

Aldon Company, Inc.—"Magnetic Mini-Light for Sign Holders" visited Jul. 27, 2018 at https.www.aldonco.com/store/p/50-Magnetic-mini-light-for-Sign-Holders.aspx.

Aldon Company, Inc.—"Magnet Base Solar Lantern" visited Jul. 27, 2018 at https://www.aldonco.com/store/p/571-Magnet-base-solar-lantern.aspx.

Aldon Company, Inc.—"Flashing Solar Combo Light with Mounting Bracket" visited Jul. 27, 2018 at https://www.aldonco.com/store/p/941-Flashing-Solar-Combo-Light-with-mounting bracket.aspx.

Aldon Company, Inc.—"Flashing Blue Light for Sign Holders and Chocks" visited Jul. 27, 2018 at https://www.aldonco.com/store/p/51-Flashing-Blue-Light-for-Sign-Holders-and-Chocks.aspx.

Aldon Company, Inc.—"Clip-on Flashing Light—Blue" visited Jul. 27, 2018 at https://www.aldonco.com/store/p/567-Clip-on-Flashing-Light-Blue.aspx.

Aldon Company, Inc.—"Solar Flashing Light, Blue, with Magnet Bracket" visited Jul. 27, 2018 at http://www.aldonco.com/store/p/572-Solar-Flashing-Light-Blue-with-Magnet-Bracket.aspx.

Railroad Tools and Solutions LLC—"Ergonomic Stand and Opposite Throw Connecting Rod" visited Jul. 30, 2018 at http://www.rrtoolsnsolutions.com/trackAccessories/Derails.asp.

Switchrit D.A.S. Rail Enterprises—"Switchrite Derail Model" visited Jul. 30, 2018 at https://switchrite.com/products/.

The Nolan Company—"AOD-1 Automated Derail Operator" visited Jul. 30, 2018 at https://nolancompany/products/aod-1-automated-derail-operator/.

The Nolan Company—"EOD-1 Automated Derail Operator" visited Jul. 30, 2019 at https://nolancompany.com/products/eod-1-automated-derail-operator/.

* cited by examiner

DERAIL WARNING LIGHT SYSTEM

CROSS-REFERENCE TO RELATED APPLICATIONS

This application claims priority to U.S. Provisional Patent Application No. 62/727,366, filed Sep. 5, 2018, entitled Derail Warning Light System, which is incorporated herein by reference in its entirety and made a part hereof.

FIELD OF THE INVENTION

The present invention relates to railways and, more particularly, to an indicator or warning light for derail or switch on a railway.

BACKGROUND

Currently, there is no portable indicator or LED indicator that can be turned on or turned off automatically based on the orientation of the derail, switch or metal flag. Currently, locomotive operators have a hard time seeing the orientation of the derail or switch point and in many cases hit the derail or switch point and derail. In many cases, nothing is placed as a more visual warning. In some cases, lights and flags are placed in those location, but the lights have to be constantly monitored and charged and the flags are hard to see and become ineffective. There is a need for a portable indicator that can be automatically turned on and turned off based on the orientation of the derail, switch, or metal flag.

SUMMARY

Aspects of the disclosure relate to a derail warning system that may include a solar-powered LED indicator for derail or switch. The derail warning system may also include an orientation sensor that automatically turns on depending on the orientation of the derail (up or down), derail metal flag, or switch indicator flag. The derail warning system may bring more visibility with a 360-degree LED that is solar powered and may detect orientation and turn on based on the position of the derail, switch, or flag. The derail warning system may use a unique acceleration sensor or g-sensor that can detect orientation movement and automatically turn on or off and be fully charged to operate day or night. The derail warning system may also include a data-logging microprocessor to determine a time stamp of position and location.

According to an embodiment, a derail warning system for use on a rail includes a derail device and a derail warning light. The derail device may include includes a mounting section that mounts to the rail and a rotatable base plate adjacent to the mounting section. The derail warning light may include a plurality of LEDs configured to turn ON when the derail device is in a DERAIL position and turn OFF when the derail device is in a NON-DERAIL position. The derail warning light may include a mounting device that attaches the derail device to the base plate of the derail device. The derail warning light may further include a microprocessor and an orientation sensor. The microprocessor may include data storage capabilities for time-stamping and data-logging the DERAIL positions and NON-DERAIL positions of the derail device. The orientation sensor may sense the DERAIL position and the NON-DERAIL position and automatically turn on the derail warning light based on the position of the derail device.

Further, the railway cover board may include the mounting section that includes a pair of rotating brackets and a rotating pin to connect the base plate to the mounting section. The pair of rotating brackets and the rotating pin may allow the base plate and the derail device to rotate from the "NON-DERAIL" position to the "DERAIL" position. The mounting device may be a clamp to mechanically attach and connect the derail warning light to the base plate of the derail device. The clamp may mechanically attach to a handle ?? bar that extends along the base plate of the derail device. The mounting device may include a magnet to magnetically attach and connect the derail warning light to the base plate of the derail device. The derail warning light may include a solar power panel that provides power via solar energy to the derail warning light, the plurality of LEDs, the microprocessor, and the orientation sensor. The microprocessor may be programmable to include data logging to record and log any and all data from the derail warning system, and further wherein the data logged is uploaded to be analyzed and reviewed. The plurality of LEDs may be multi-colored arrangements to include blue, red, amber, white, and green. Further, rotating the base plate and the derail warning light to the "NON-DERAIL" position may cause a first side of the mounting device to be facing upward and rotating the base plate and the derail warning light to the "DERAIL" position may cause a second side of the mounting device to be facing upward. The orientation sensor may include a tilt sensor and/or a compass sensor. The plurality of LEDs are located around the periphery of the derail warning light.

According to another embodiment, a derail warning system for use on a rail may include a derail device and a derail warning light. The derail device may include a mounting section that mounts to the rail and a rotatable base plate adjacent to the mounting section. The mounting section may include a pair of rotating brackets and a rotating pin to connect the base plate to the mounting section. The derail warning light may include a plurality of LEDs configured to turn ON when the derail device is in a DERAIL position and turn OFF when the derail device is in a NON-DERAIL position. The derail warning light may include a mounting device that attaches the derail device to the base plate of the derail device. The derail warning light may further include a microprocessor and an orientation sensor, wherein the microprocessor includes data storage capabilities for time-stamping and data-logging the DERAIL positions and NON-DERAIL positions of the derail device. The microprocessor may be programmable to include data logging to record and log any and all data from the derail warning system, and wherein the data logged is uploaded to be analyzed and reviewed. The derail warning light may include a solar power panel that provides power via solar energy to the derail warning light, the plurality of LEDs, the microprocessor, and the orientation sensor. Further, the orientation sensor may senses the DERAIL position and the NON-DERAIL position and automatically turn on the derail warning light based on the position of the derail device, wherein rotating the base plate and the derail warning light to the "NON-DERAIL" position may cause a first side of the mounting device to be facing upward and rotating the base plate and the derail warning light to the "DERAIL" position may cause a second side of the mounting device to be facing upward.

In yet another embodiment, a derail warning system for use on a rail may include a derail device and a derail warning light. The derail device may include a mounting section that mounts to the rail and a rotatable base plate adjacent to the mounting section. The mounting section may include a pair of rotating brackets and a rotating pin to connect the base plate to the mounting section. The derail warning light may include a plurality of LEDs configured to turn ON when the derail device is in a DERAIL position and turn OFF when the derail device is in a NON-DERAIL position. The derail warning light may include a mounting device that attaches the derail device to the base plate of the derail device. The derail warning light may further include a microprocessor and an orientation sensor with a tilt sensor and a compass sensor. The microprocessor may include data storage capabilities for time-stamping and data-logging the DERAIL positions and NON-DERAIL positions of the derail device. The orientation sensor may sense the DERAIL position and the NON-DERAIL position and automatically turn on the derail warning light based on the position of the derail device, wherein rotating the base plate and the derail warning light to the "NON-DERAIL" position may cause a first side of the mounting device to be facing upward and rotating the base plate and the derail warning light to the "DERAIL" position may cause a second side of the mounting device to be facing upward.

These features, along with many others, are discussed in greater detail below.

Figure 1A:
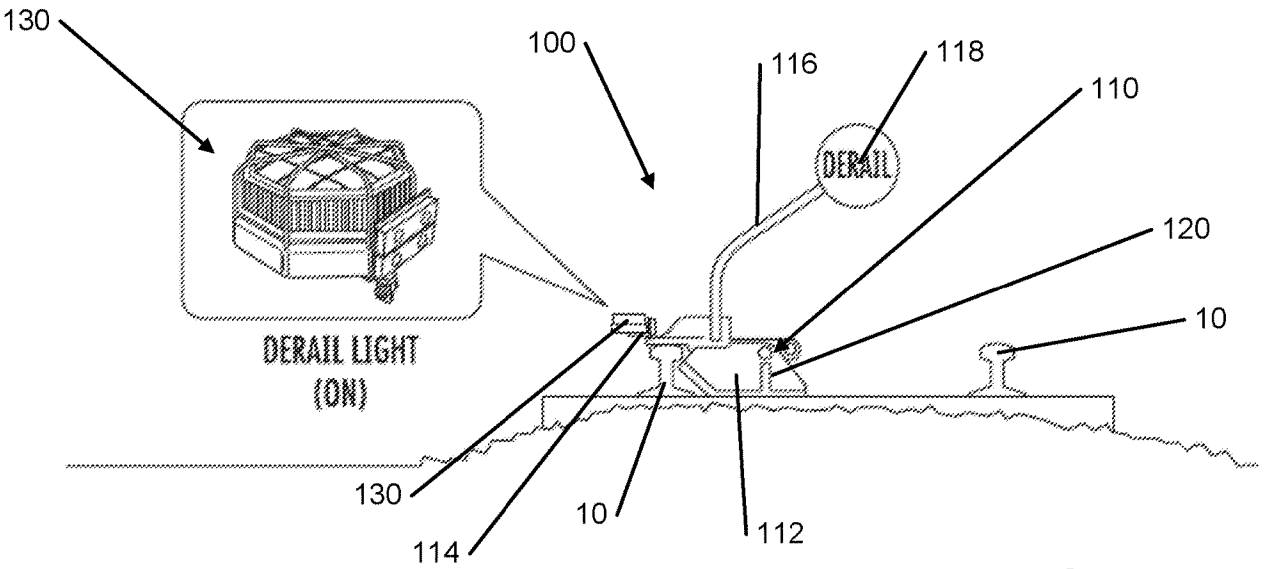
FIG. 1A is side view of a derail warning system on a railway in a derail position with a derail warning light ON in accordance with an embodiment of the system of the present invention.

The reader is advised that the attached drawings are not necessarily drawn to scale.

DETAILED DESCRIPTION OF EMBODIMENTS

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

In the railroad industry it is often necessary to conduct maintenance or repairs of various sections of rail or tracks. This is relevant in high-rail traffic locations, such as for example in rail yards. In addition, sections of track may simply be shut down due to condition or other factors. It is often desirable to prevent the undesired or unauthorized movement of trains or rail cars across particular sections of track at particular times. When sections of track are shut down or need to be blocked from rail traffic, it is a standard procedure to place and engage one or more derail warning systems or derail devices on the tracks to prevent a train or other rail equipment from traversing those tracks where the derail device is engaged. These derail devices force the errant train or other rail equipment off of the tracks and onto the ground or onto a side rail beside the tracks at the position of the derail device.

There are several configurations of derail devices, such as "hinged", "slide" and "portable." All derail devices generally comprise a wedge component that is designed to be positioned over the top of one rail along a section of tracks. This wedge is shaped such that should a locomotive or other rail car traverse the derail device, the wedge will lift the wheels riding on the rail with the derail device and direct those wheels across and over the rail to the ground beside the tracks or onto a platform or other surface adjacent the derail device. A sign or warning may be positioned atop the rail in an "Active" or "ON" or "DERAIL" position, or alternately in one or more other positions not atop the rail, in an "Inactive" or "OFF" or "NON-DERAIL" position. That is, when not in use or engaged, the wedge component of the derail device can be folded or collapsed or moved away from the top of the rail in order to leave the rail unobstructed.

It is critical that when a derail device is positioned upon a section of tracks with the wedge in the "Active" or "ON" or "DERAIL" position—that is, when the derail device is configured to derail—that rail traffic has adequate notice of such "active" derail in order to prevent unintended or otherwise unnecessary derailings from occurring along that section of the track. FIGS. 1A through 4 illustrate a derail warning system 100 that provides adequate notice of the "DERAIL" position. FIGS. 5A through 7B illustrate a second embodiment of a derail warning system 500 that provides adequate notice of the "DERAIL" position.

The derail warning system 100 may include a solar-powered LED indicator for derail or switch. The derail warning system 100 may also include an orientation sensor that automatically turns on depending on the orientation of the derail (up or down), derail metal flag, or switch indicator flag. The derail warning system 100 may bring more visibility with a flashing 360-degree LED that is solar powered and may detect orientation and turn on based on the position of the derail, switch, or flag. The derail warning system 100 may use an acceleration sensor or g-sensor that can detect orientation movement and automatically turn on or off and be fully charged to operate day or night. The derail warning system 100 may include multi-colored arrangements from blue, red, amber, white, and green.

The derail warning system 100 may include one or more of the following features: 360-degree viewable LED indicator, orientation sensor/acceleration sensor or g-sensor to allow for orientation position indication and automatic ON/OFF, portable device that can be mounted on a handle using a clamp, solar-powered, a data-logging microprocessor to determine a time stamp of position and location, a protection cage, and an octagon shape to allow multiple colors in one unit.

Figure 1B:
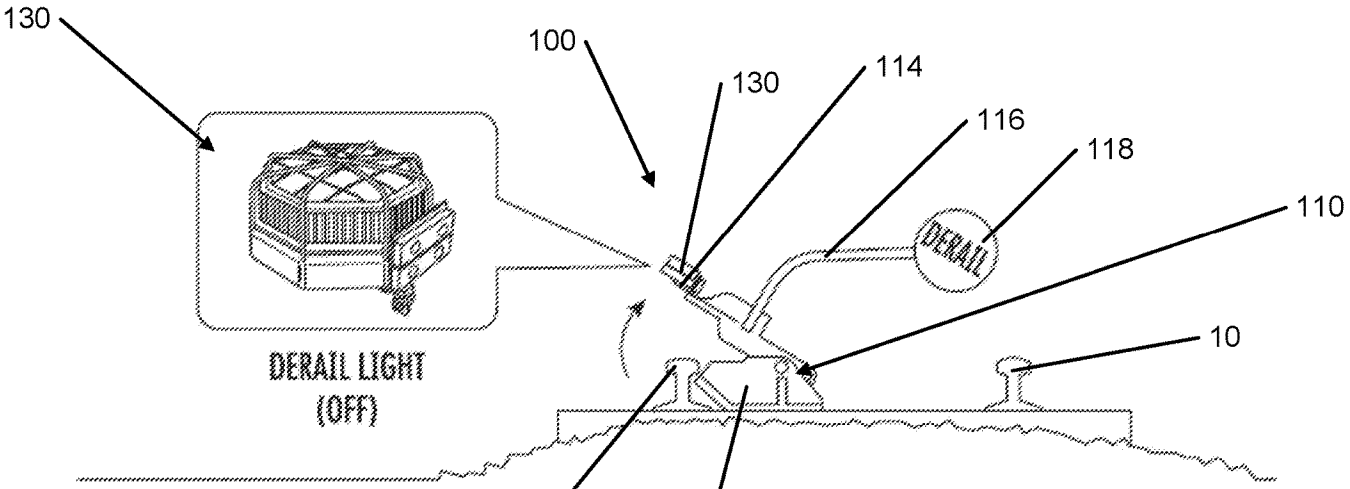
FIG. 1B is side view of the derail warning system from FIG. 1A in a non-derail position with the derail warning light OFF in accordance with an embodiment of the system of the present invention.
Figure 2:
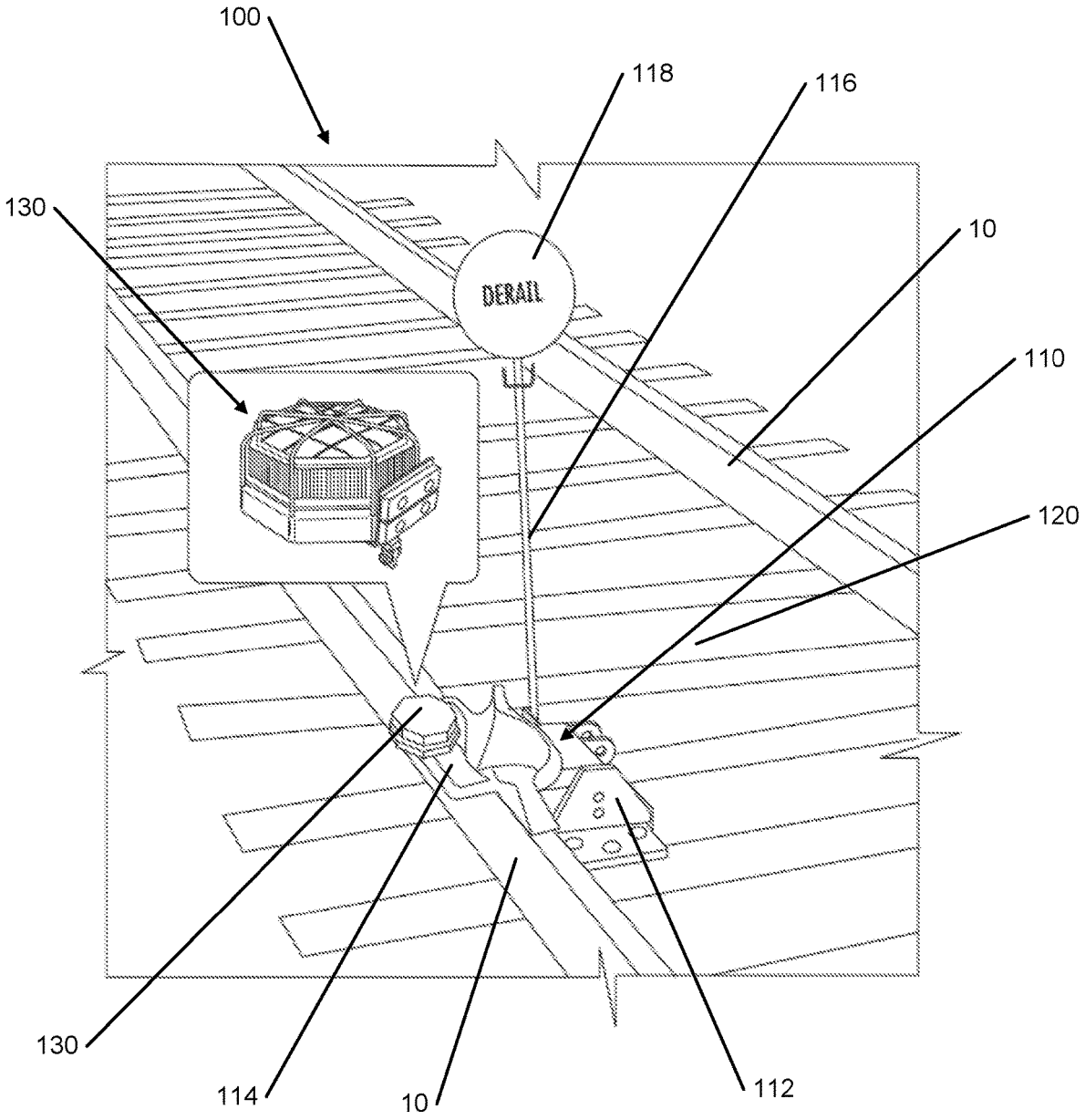
FIG. 2 is top perspective view of the derail warning system from FIGS. 1A and 1B in accordance with an embodiment of the system of the present invention.

As illustrated in FIGS. 1A, 1B, and FIG. 2, the derail warning system 100 includes a derail device 110 and a derail warning light 130. FIG. 1A illustrates the derail warning system 100 on a railway in a derail position with a derail warning light ON. FIG. 1B illustrates the derail warning system 100 on a railway in a non-derail position with the derail warning light OFF.

The derail device 110 may be located on a rail 10 of a railyard. The derail device 110 may include a mounting section 112 that mounts or attaches to the rail 10. The derail device 110 may also include a base plate 114 adjacent to the mounting section 112. The derail device 110 may further include a warning arm 116 with a warning sign 118. The warning arm 116 and the warning sign 118 may move or rotate from the "Active" or "ON" or "DERAIL" position as illustrated in FIG. 1A to the "Inactive" or "OFF" or "NON-DERAIL" position in FIG. 1B. The derail device 110 may be various other configurations without departing from this invention.

As illustrated in FIG. 2, a derail warning light 130 may be included with the derail warning system 100. The derail warning light 130 may be located on the derail device 110. Specifically, the derail warning light 130 may be located on the base plate 114 of the derail device 110. Generally, the derail warning light 130 may be configured to turn ON when the derail device 110 is in the "Active" or "ON" or "DERAIL" position as illustrated in FIG. 1A. The derail warning light 130 may also be configured to turn OFF when the derail device 110 is in the "Inactive" or "OFF" or "NON-DERAIL" position in FIG. 1B.

Figure 3:
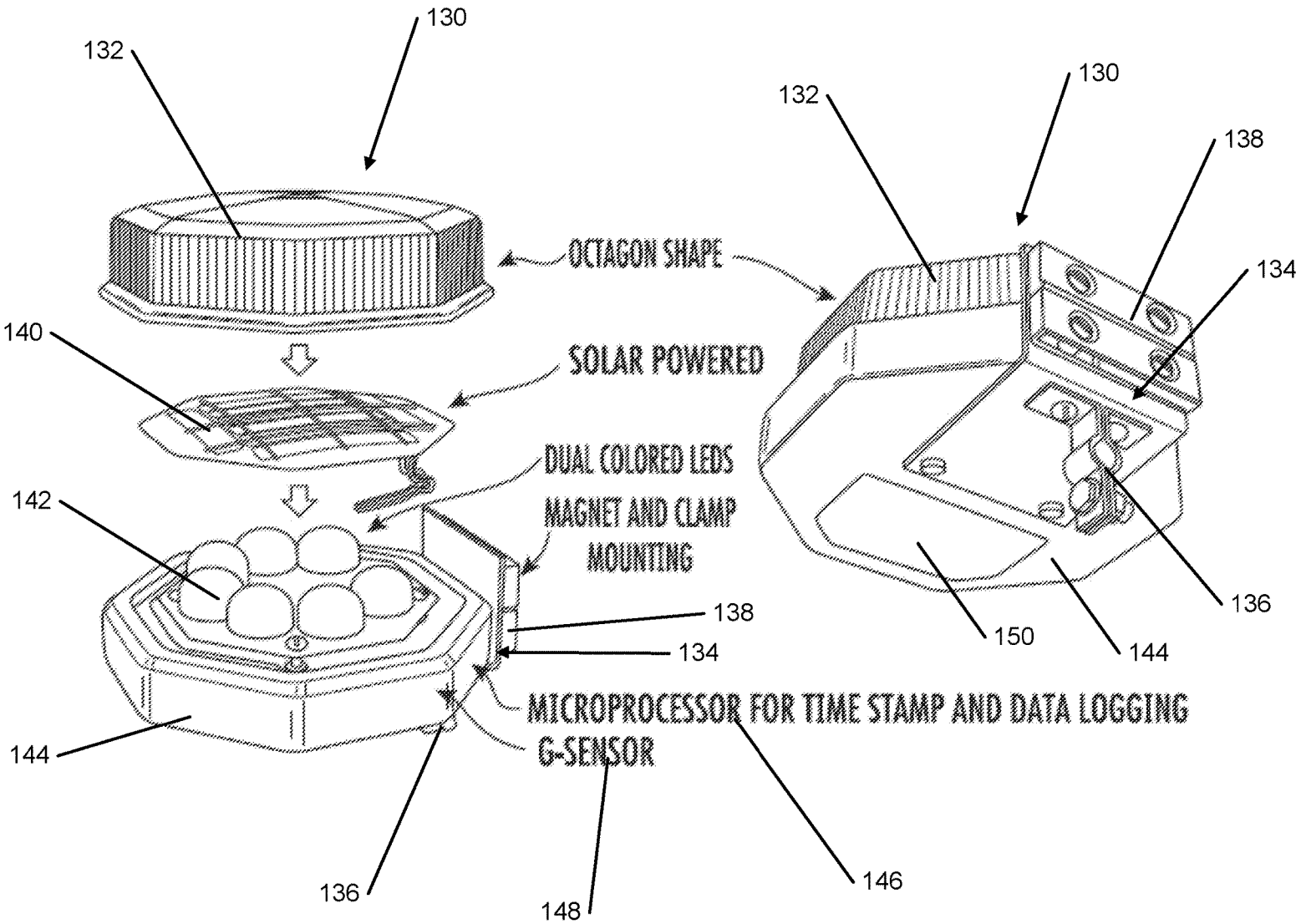
FIG. 3 is an exploded view of the derail warning light illustrated in FIGS. 1A and 1B in accordance with an embodiment of the system of the present invention.

FIG. 3 illustrates an exploded view of the derail warning light 130 with various components and features. As illustrated in FIG. 3, the derail warning light 130 may include a cover 132. The cover 132 may be opaque or clear. The cover 132 may be an octagon shape to allow multiple colors for LED lights. Additionally, the cover 132 will provide a 360-degree viewable LED indicator for the derail warning light 130. Other shapes may be utilized for the cover 132 and the derail warning light 130 without departing from this invention.

Additionally, as illustrated in FIG. 3, the derail warning light 130 may include a mounting device 134 to mount and connect to the base plate 114 of the derail device 110. The mounting device 134 may include a clamp 136 to mechanically attach and connect to the base plate 114 of the derail device 110. The mounting device 134 may also include a magnet 138 to magnetically attach and connect to the base plate 114 of the derail device 110.

Additionally, as illustrated in FIG. 3, the derail warning light 130 may include a solar power panel 140. The solar power panel 140 may provide the full power via solar energy to the derail warning light 130, such as to the LEDs 142, the microprocessor 146, and the orientation sensor 148. The solar power panel 140 may be various solar panels known to those of skill in the art without departing from this invention. The derail warning light 130 may also be battery powered or partial battery powered without departing from this invention.

As further illustrated in FIG. 3, the derail warning light 130 may include a base 144 that attaches to the cover 132. The base 144 and cover 132 may provide a snap-fit connection or other mechanical connection as known and used in the art, such as via fasteners. Within the base 144, the derail warning light 130 may also include a microprocessor 146. The microprocessor 146 may include data storage capabilities as well. Generally, the microprocessor will be utilized for time stamping and data-logging the various movements of the derail device 110. The microprocessor 146 may be programmable to include various data logging features as well and to record and log any and all data from the derail warning system 100. The data logged may then be uploaded to be analyzed and reviewed as needed and required.

Additionally, within the base 144, the derail warning light 130 may also include an orientation sensor 148. The orientation sensor 148 may be an accelerometer or g-sensor. The orientation sensor 148 will sense the orientation of the derail device 110 and automatically turn ON or turn OFF based on the position of the derail device 110. The orientation sensor can detect orientation movement and automatically turn on or off in order to be fully charged to operate day or night. The base 144 may also include an access door 150 in order to access the microprocessor 146 and/or the orientation sensor 148. The orientation sensor 148 may include a tilt sensor and/or a compass sensor.

Furthermore, within the base 144 and under the cover 132, the derail warning light 130 may include a plurality of LEDs 142. The LEDs 142 may be dual-colored LEDs. As illustrated in FIG. 3, the derail warning light 130 may include seven different LEDs. Other numbers of LEDs 142 may be utilized with the derail warning light 130 without departing from this invention, such as, for example, 3 LEDs, 4 LEDs, 5 LEDs, 6 LEDs, or 8 LEDs. Other types of lighting sources may be utilized without departing from this invention. The LEDs 142 may be multi-colored arrangements that include blue, red, amber, white, and green.

Figure 4:
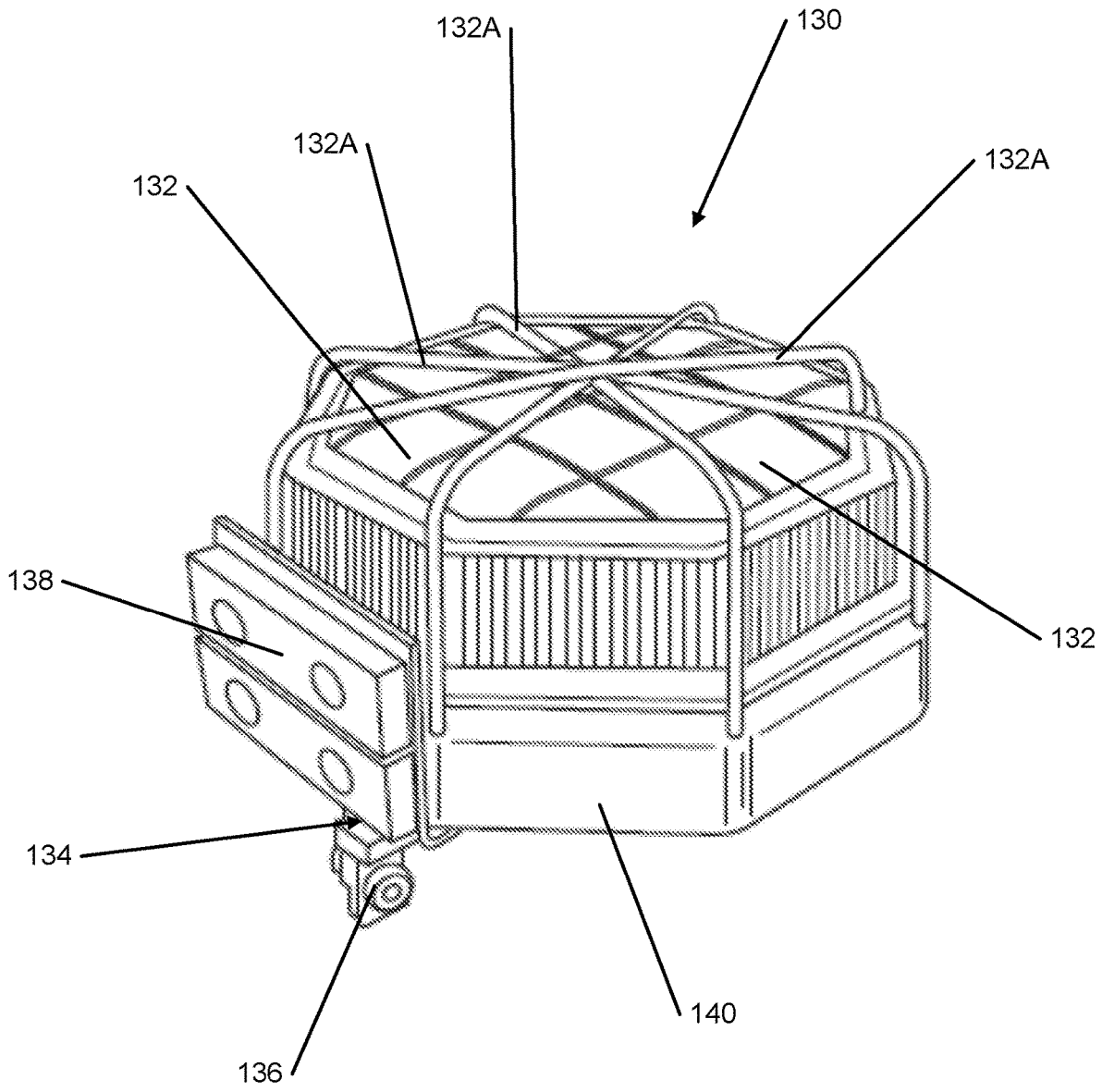
FIG. 4 is a front perspective view of the derail warning light illustrated in FIGS. 1A and 1B in accordance with an embodiment of the system of the present invention.

FIG. 4 illustrates another feature of the derail warning light 130 that might be utilized. The derail warning light may also include a protective cover 132A in place of the cover 132. The protective cover 132A may include multiple bars 133 that extend across the cover 132 and meet in the center of the cover. The bars 133 may provide protection for the cover 132 against breakage and shattering.

Figure 5A:
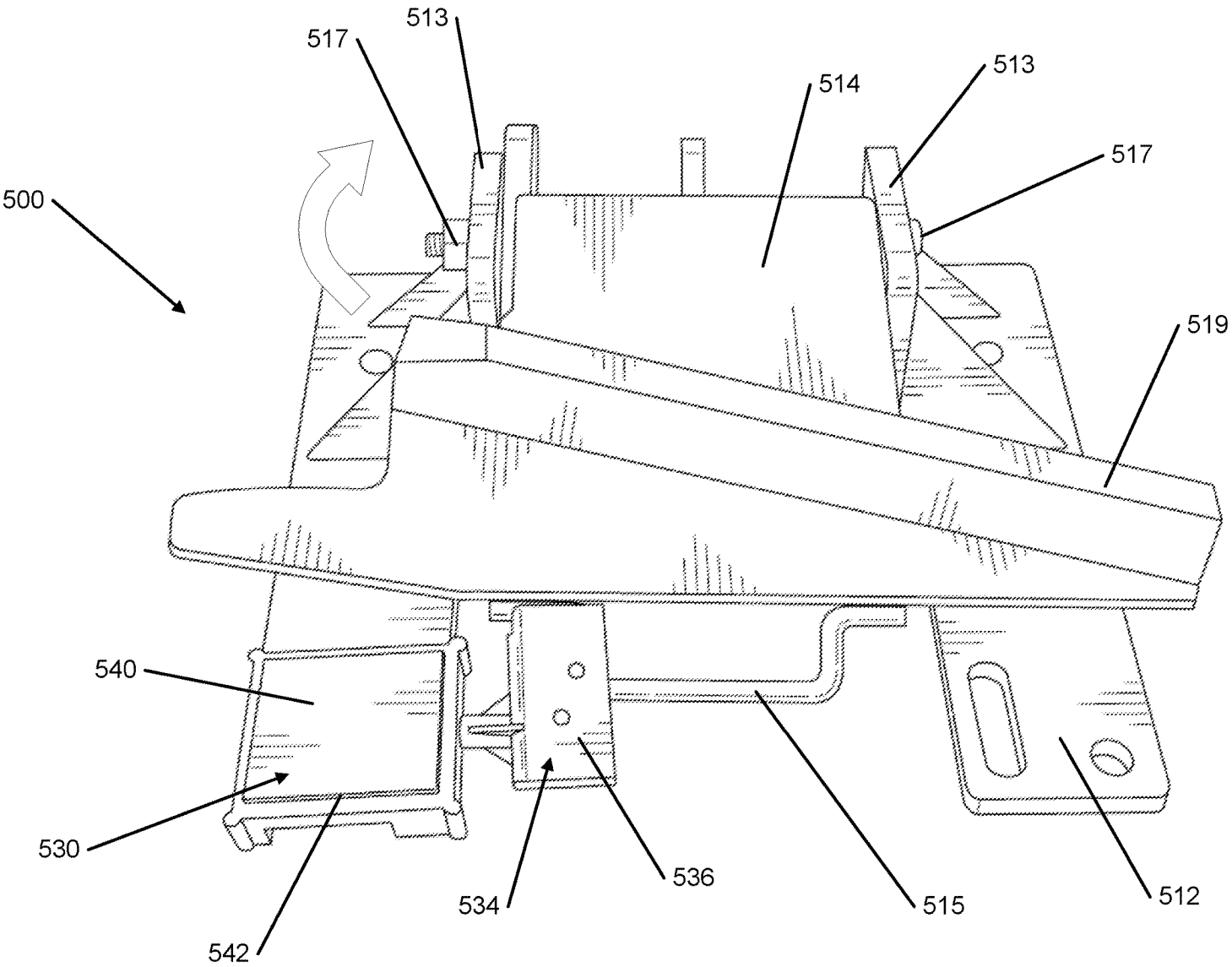
FIG. 5A is a side perspective view of another embodiment of a derail warning system in a non-derail position in accordance with an embodiment of the system of the present invention.
Figure 5B:
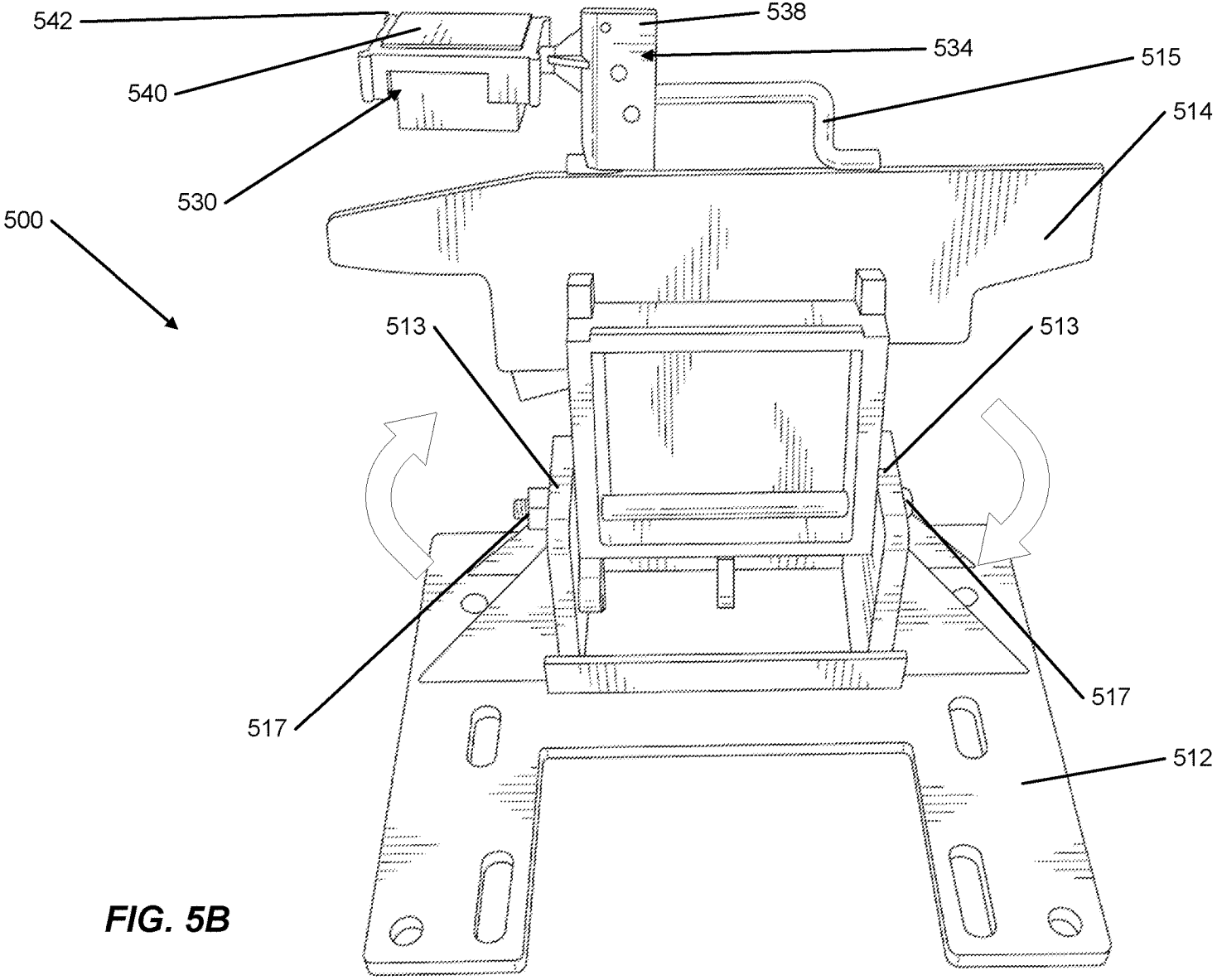
FIG. 5B is a side perspective view of the derail warning system from FIG. 5A moving from the non-derail position to the derail position in accordance with an embodiment of the system of the present invention.
Figure 5C:
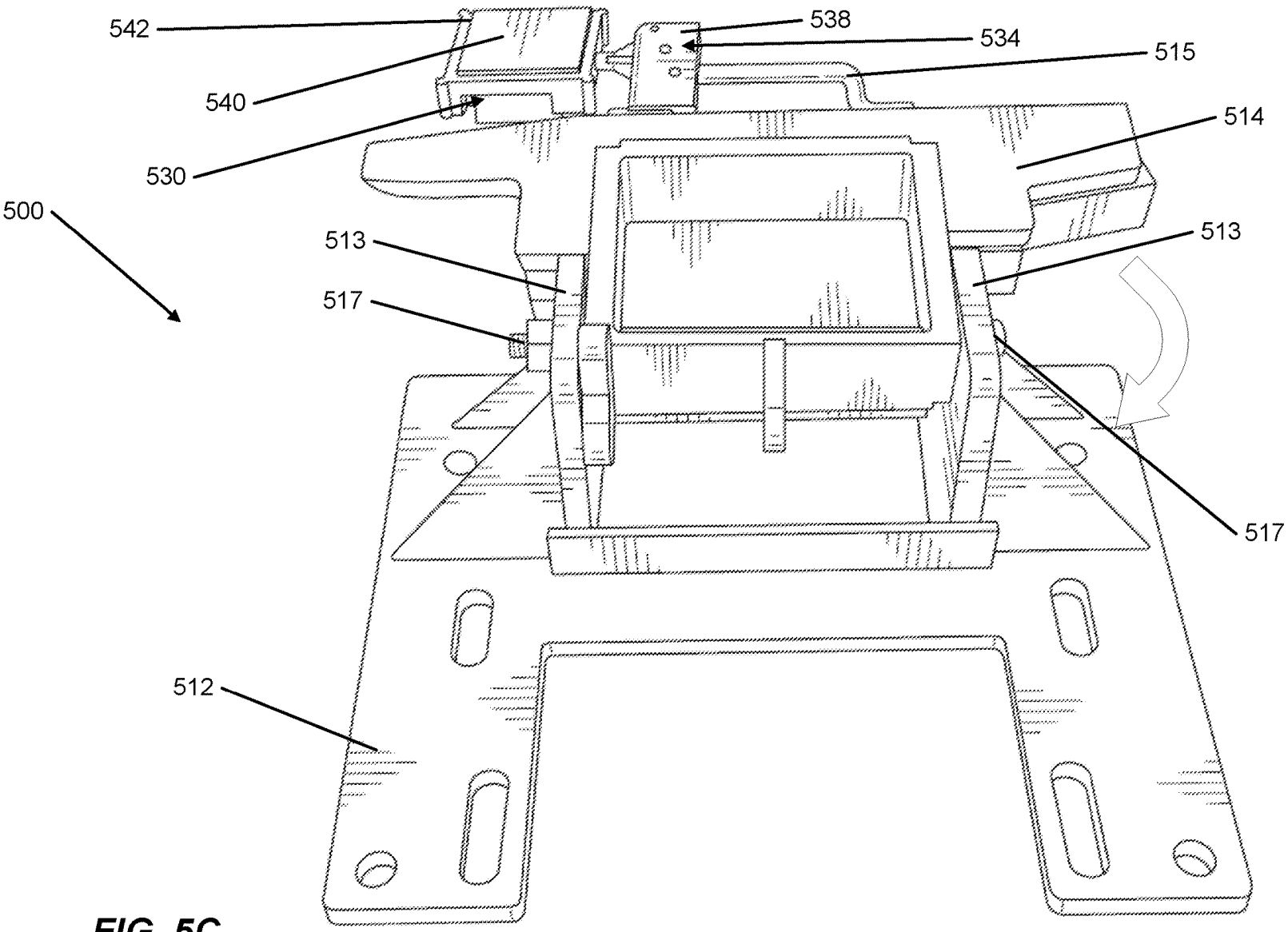
FIG. 5C is a side perspective view of the derail warning system from FIG. 5A in a derail position in accordance with an embodiment of the system of the present invention.
Figure 6A:
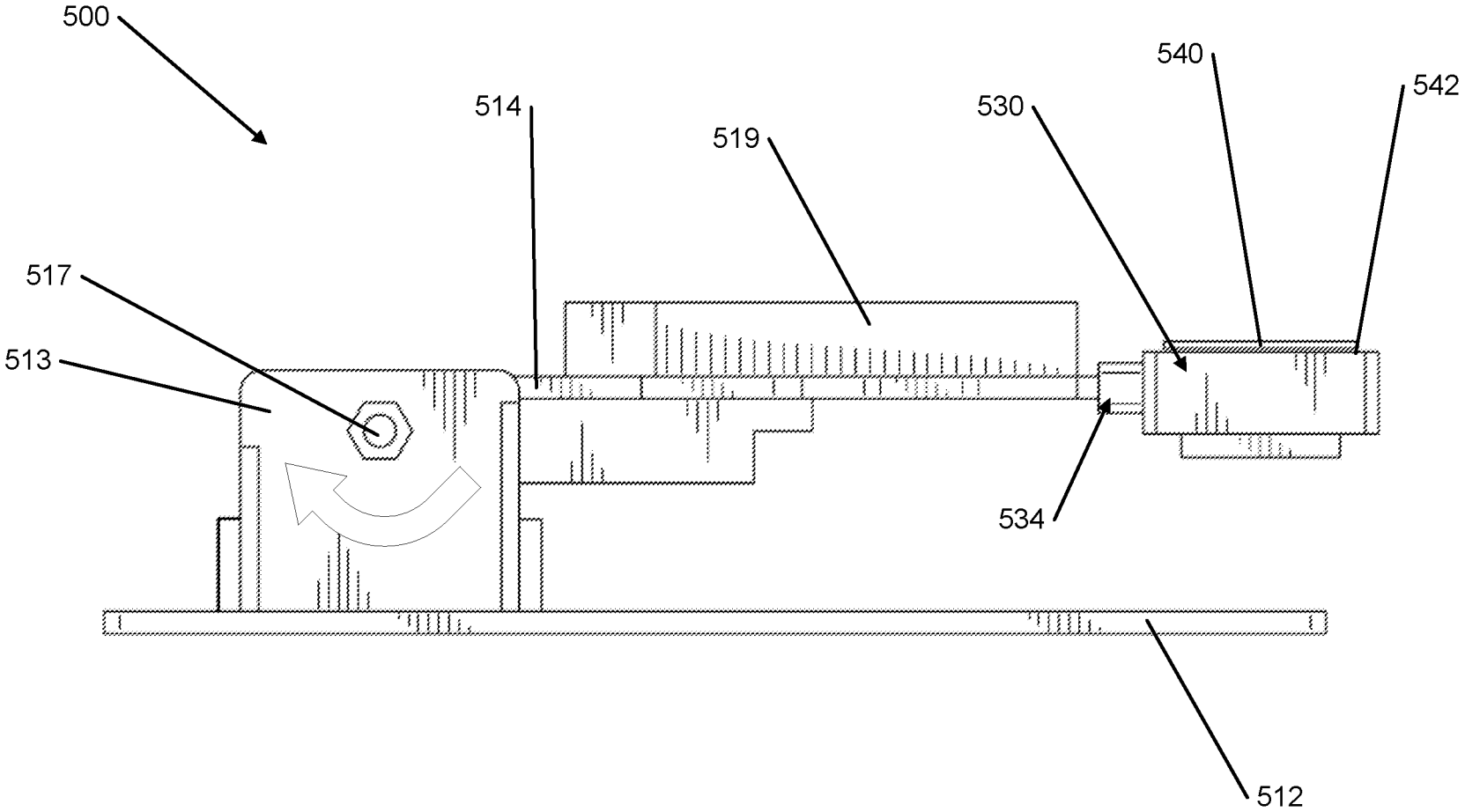
FIG. 6A is a front perspective view of the derail warning system from FIG. 5A in a non-derail position in accordance with an embodiment of the system of the present invention.
Figure 6B:
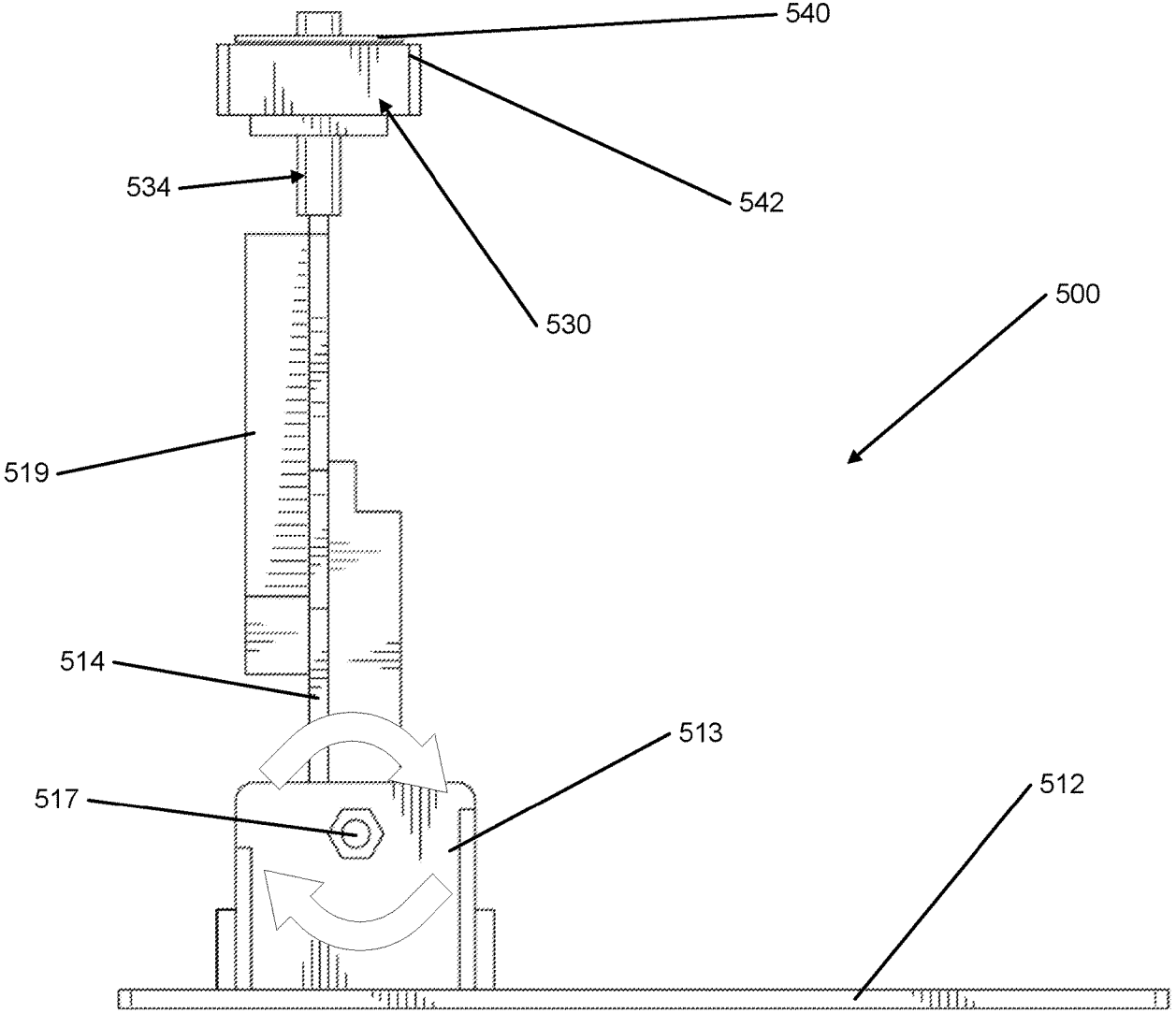
FIG. 6B is a front perspective view of the derail warning system from FIG. 5A moving from the non-derail position to the derail position in accordance with an embodiment of the system of the present invention.
Figure 6C:
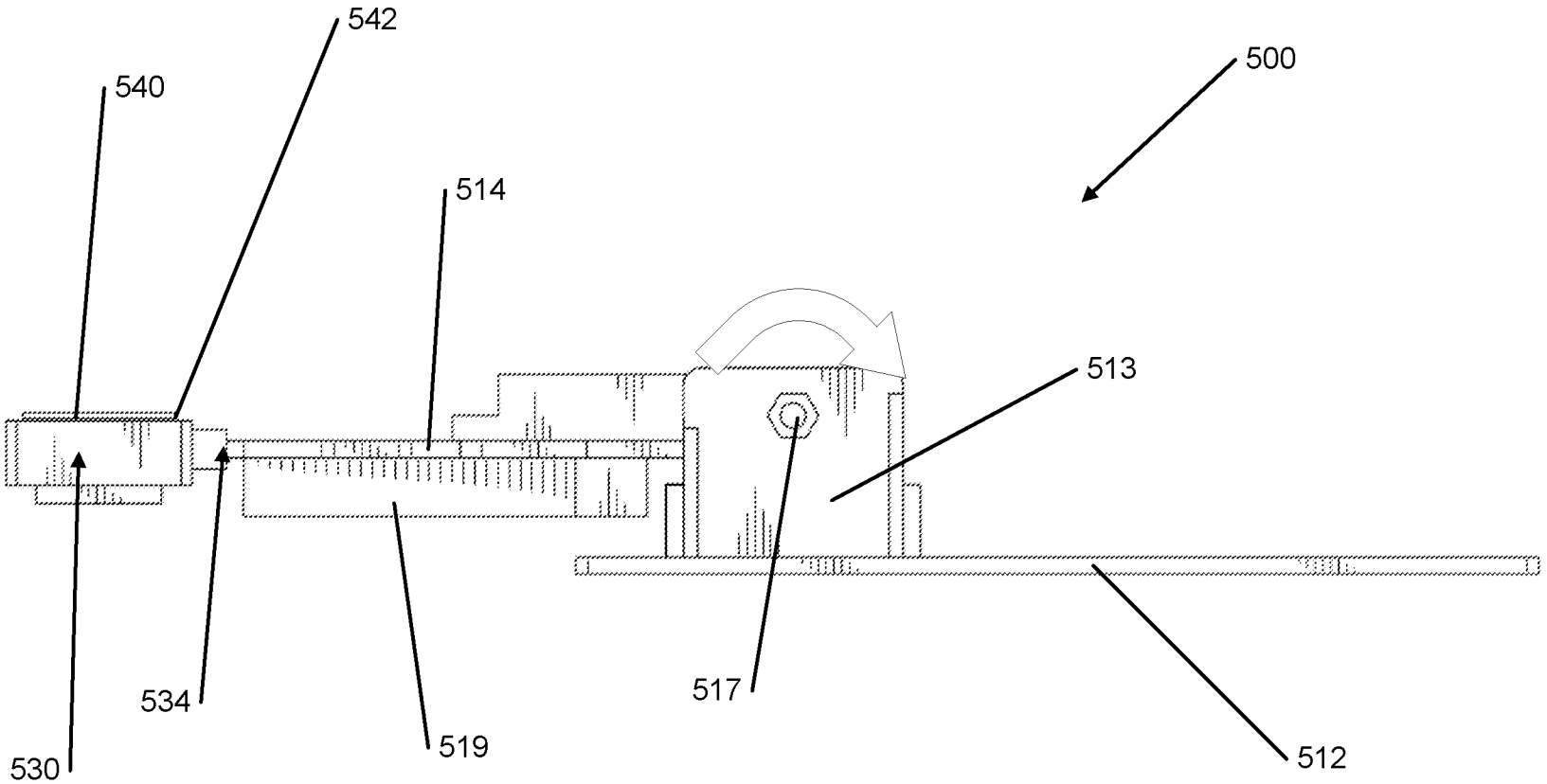
FIG. 6C is a front perspective view of the derail warning system from FIG. 5A in a derail position in accordance with an embodiment of the system of the present invention.
Figure 7A:
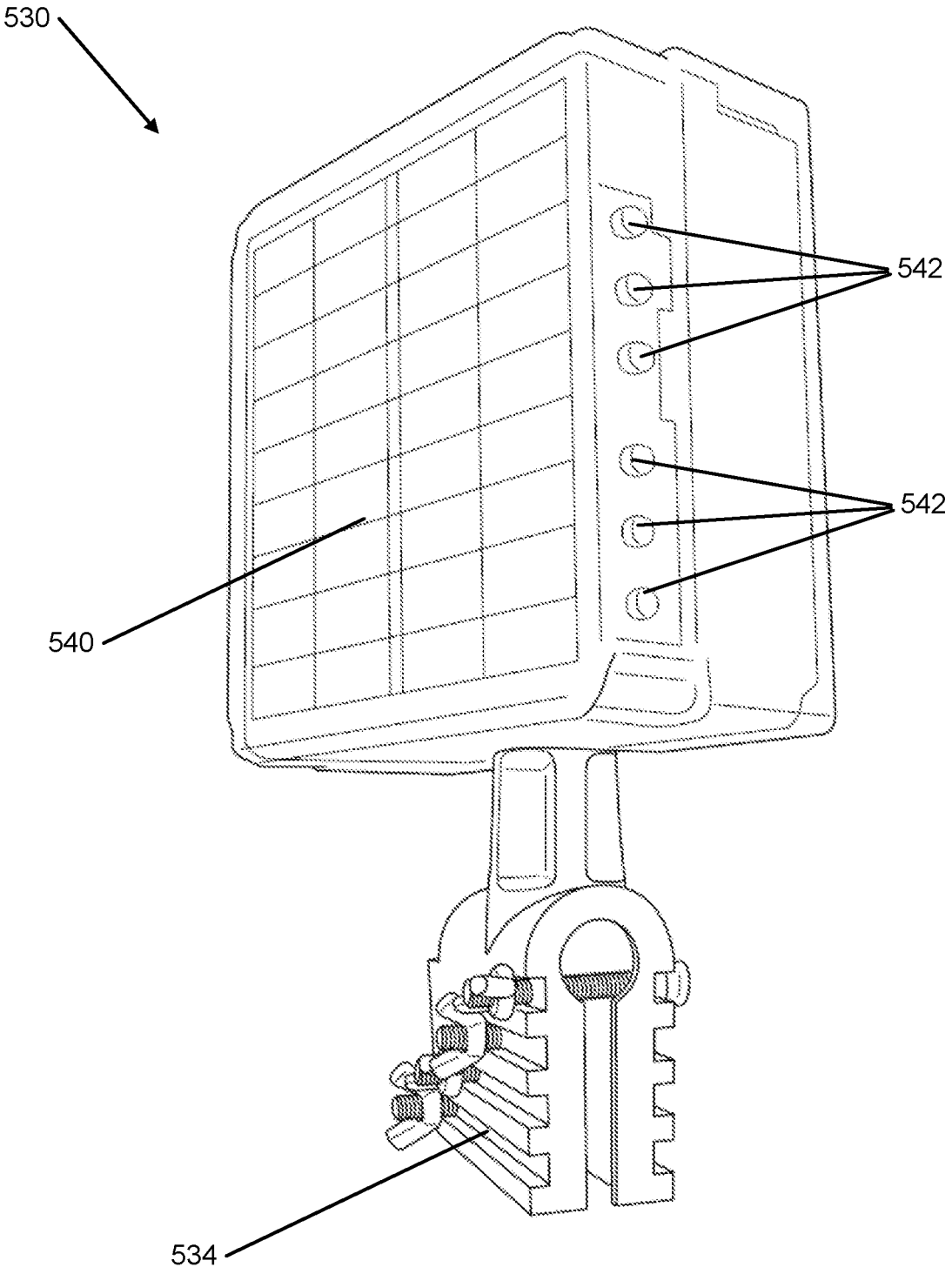
FIGS. 7A and 7B are perspective views of the derail warning light from FIG. 5A in accordance with an embodiment of the system of the present invention.
Figure 7B:
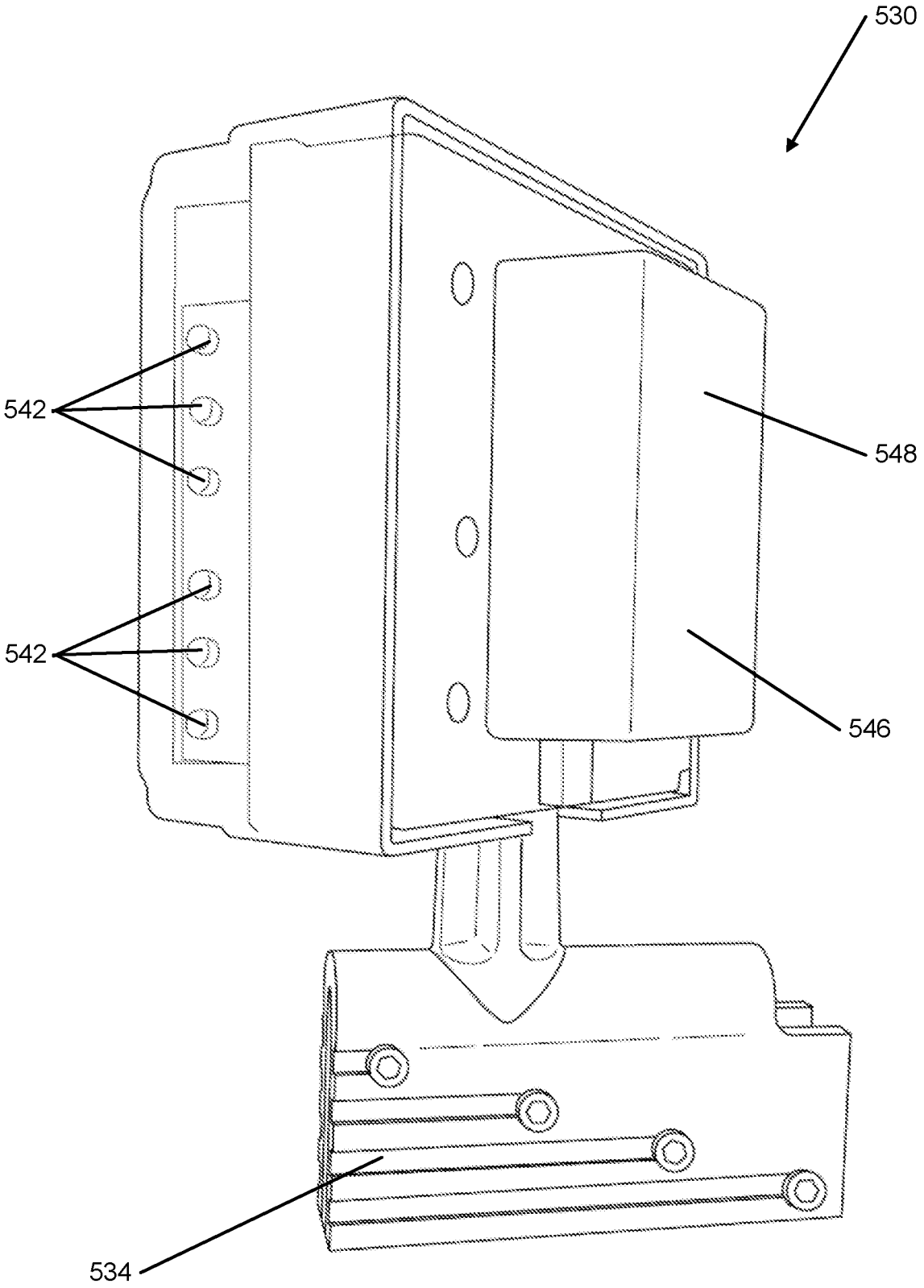

FIGS. 5A-7B illustrate a second embodiment of a derail warning system 500. Specifically, FIG. 5A is a side perspective view of the derail warning system 500 in a non-derail position; FIG. 5B is a side perspective view of the derail warning system 500 moving from the non-derail position to the derail position; FIG. 5C is a side perspective view of the derail warning system 500 in a derail position; FIG. 6A is a front perspective view of the derail warning system 500 in a non-derail position; FIG. 6B is a front perspective view of the derail warning system 500 moving from the non-derail position to the derail position; FIG. 6C is a front perspective view of the derail warning system 500 in a derail position; and FIGS. 7A and 7B are perspective views of the derail warning light from FIG. 5A in accordance with an embodiment of the system of the present invention. For embodiment of FIGS. 5A-7B, the features are referred to using similar reference numerals under the "5xx" series of reference numerals, rather than "1xx" as used in the embodiment of FIG. 1. Accordingly, certain features of the derail warning system 500 that were already described above with respect to the derail warning system 100 of FIG. 1 may be described in lesser detail, or may not be described at all.

As illustrated in FIGS. 5A-6C, the derail warning system 500 includes a derail device 510 and a derail warning light 530. The derail device 510 may be located on a rail 10 of a railyard. The derail device 510 may include a mounting section 512 that mounts or attaches to the rail 10. The derail device 510 may also include a base plate 514 adjacent to the mounting section 512. The base plate 514 may also include a handle 515. The handle 515 may be utilized to rotate the base plate 514 between a first position and a second position. The first position may be a "NON-DERAIL" position as illustrated in FIGS. 5C and 6C. The second position may be a "DERAIL" position as illustrated in FIGS. 5A and 6A.

The mounting section 512 may include a pair of rotating brackets 513 and a rotating pin 517. The pair of rotating brackets 513 and the rotating pin 517 may be utilized to connect the base plate 514 to the mounting section 512. The pair of rotating brackets 513 and the rotating pin 517 may allow the base plate 514 to rotate from the "NON-DERAIL" position to the "DERAIL" position. The pair of rotating brackets 513 may extend perpendicularly from the mounting section 512. Additionally, the pair of rotating brackets 513 may be attached of connected to the mounting section 512 with one or more supports or struts. FIGS. 5A-6C include arrows showing the rotation of the base plate 514 and derail warning light 530 around the rotating brackets 513 and rotating pin 517. The base plate 514 may also include a derail bar 519. The derail bar 519 may extend across the base plate 514 and be utilized to hold and steady the base plate 514 in the "DERAIL" position along the rail 10 (as illustrated in FIGS. 5C and 6C).

In some embodiments, the derail device 510 may further include a warning arm with a warning sign that may move or rotate from the "Active" or "ON" or "DERAIL" position as illustrated in FIGS. 5C and 6C to the "Inactive" or "OFF" or "NON-DERAIL" position as illustrated in FIGS. 5A and 6A. The derail device 510 may be various other configurations without departing from this invention.

A derail warning light 530 may be included with the derail warning system 500. The derail warning light 530 may be located on the derail device 510. Specifically, the derail warning light 530 may be attached to the base plate 514 of the derail device 510. Generally, the derail warning light 530 may be configured to turn ON when the derail device 110 is in the "Active" or "ON" or "DERAIL" position as illustrated in FIGS. 5C and 6C. The derail warning light 530 may also be configured to turn OFF when the derail device 510 is in the "Inactive" or "OFF" or "NON-DERAIL" position as illustrated in FIGS. 5A and 6A.

Additionally, the derail warning light 530 may include a mounting device 534 to mount and connect to the base plate 514 of the derail device 510. The mounting device 534 may include a clamp to mechanically attach and connect to the base plate 514 of the derail device 510. The tightening clamp of the mounting device 534 as illustrated in FIGS. 7A and 7B includes three tightening screws, but any mechanical mounting clamp may be utilized without departing from this invention. The mounting device 534 may also include a magnet to magnetically attach and connect to the handle 515 and the base plate 514 of the derail device 510.

The mounting device 534 as connected to the base plate 514 and the derail warning light 530 may allow rotation of the base plate 514 and the derail warning light 530 when the derail device 510 is moved from the "DERAIL" position to the "NON-DERAIL" position. Additionally, the mounting device 534 may include a first side 536 and a second side 538. This rotation of base plate 514 and the derail warning light 530 causes the first side 536 of the mounting device 534 to be facing upward when the derail device 510 is in the "NON-DERAIL" position and the second side 538 of the mounting device 534 to be facing upward when the derail device 510 is in the "DERAIL" position. The first side 536 may be the "NON-DERAIL" position. When the base plate 514 and the derail warning light 530 is rotated to the "DERAIL" position, the second side 538 may be the "DERAIL" position.

Additionally, as specifically illustrated in FIG. 7A, the derail warning light 530 may include a solar power panel 540. The solar power panel 540 may provide the full power via solar energy to the derail warning light 530, such as to the LEDs 542, the microprocessor 546, and the orientation sensor 548. The solar power panel 540 may be various solar panels known to those of skill in the art without departing from this invention. The derail warning light 530 may also be battery powered or partial battery powered without departing from this invention.

The derail warning light 530 may also include a microprocessor 546. The microprocessor 546 may include data storage capabilities as well. Generally, the microprocessor will be utilized for time stamping and data-logging the various movements of the derail device 510. The microprocessor 546 may be programmable to include various data logging features as well and to record and log any and all data from the derail warning system 500. The data logged may then be uploaded to be analyzed and reviewed as needed and required.

Additionally, the derail warning light 530 may also include an orientation sensor 548. The orientation sensor 548 may be an accelerometer or g-sensor. The orientation sensor 548 will sense the orientation of the derail device 510 and automatically turn ON the derail warning light 530 (for the DERAIL position as illustrated in FIGS. 5C and 6C) or turn OFF the derail warning light 530 (for the NON-DERAIL position as illustrated in FIGS. 5A and 6A) based on the position of the derail device 510. The orientation sensor 548 can detect orientation movement and automatically turn on or off in order to be fully charged to operate day or night. The derail warning light 530 may also include an access door in order to access the microprocessor 146 and/or the orientation sensor 148 or any other electronics for maintenance. Additionally, the orientation sensor 548 may include a tilt sensor and/or a compass sensor. The tilt sensor may be a MEMS digital output motion sensor with a ultra-low-power high-performance 3-axis nano-accelerometer. The tilt sensor may be an embedded state machine that can be programed to implement autonomous applications and be dynamically selectable and capable of measuring accelerations with output data rates from 3.125 Hz to 1.6 Hz.

The compass sensor may be a digital output magnetic sensor with ultra-low-power, high performance 3-axis magnetometer.

Furthermore, the derail warning light 530 may include a plurality of LEDs 542. The plurality of LEDs 542 may be located around the outer periphery of the derail warning light 530. The LEDs 542 may be dual-colored LEDs. The derail warning light 530 may include several different LEDs. Other types of lighting sources may be utilized without departing from this invention. The LEDs 542 may be multi-colored arrangements that include blue, red, amber, white, and green.

Additionally, the derail warning system 500 may include a solar-powered LED indicator for derail or switch. The derail warning system 500 may also include an orientation sensor that automatically turns on depending on the orientation of the derail (up or down), derail metal flag, or switch indicator flag. The derail warning system 500 may bring more visibility with a flashing 360-degree LED that is solar powered and may detect orientation and turn on based on the position of the derail, switch, or flag. The derail warning system 500 may use a unique acceleration sensor or g-sensor that can detect orientation movement and automatically turn on or off and be fully charged to operate day or night. The derail warning system 500 may include multi-colored arrangements from blue, red, amber, white, and green.

The derail warning system 500 may include one or more of the following features: 360-degree viewable LED indicator, orientation sensor/acceleration sensor or g-sensor to allow for orientation position indication and automatic ON/OFF, portable device that can be mounted on a handle using a clamp, solar-powered, a data-logging microprocessor to determine a time stamp of position and location, and various shapes to allow multiple colors in one unit.

Figure 8:
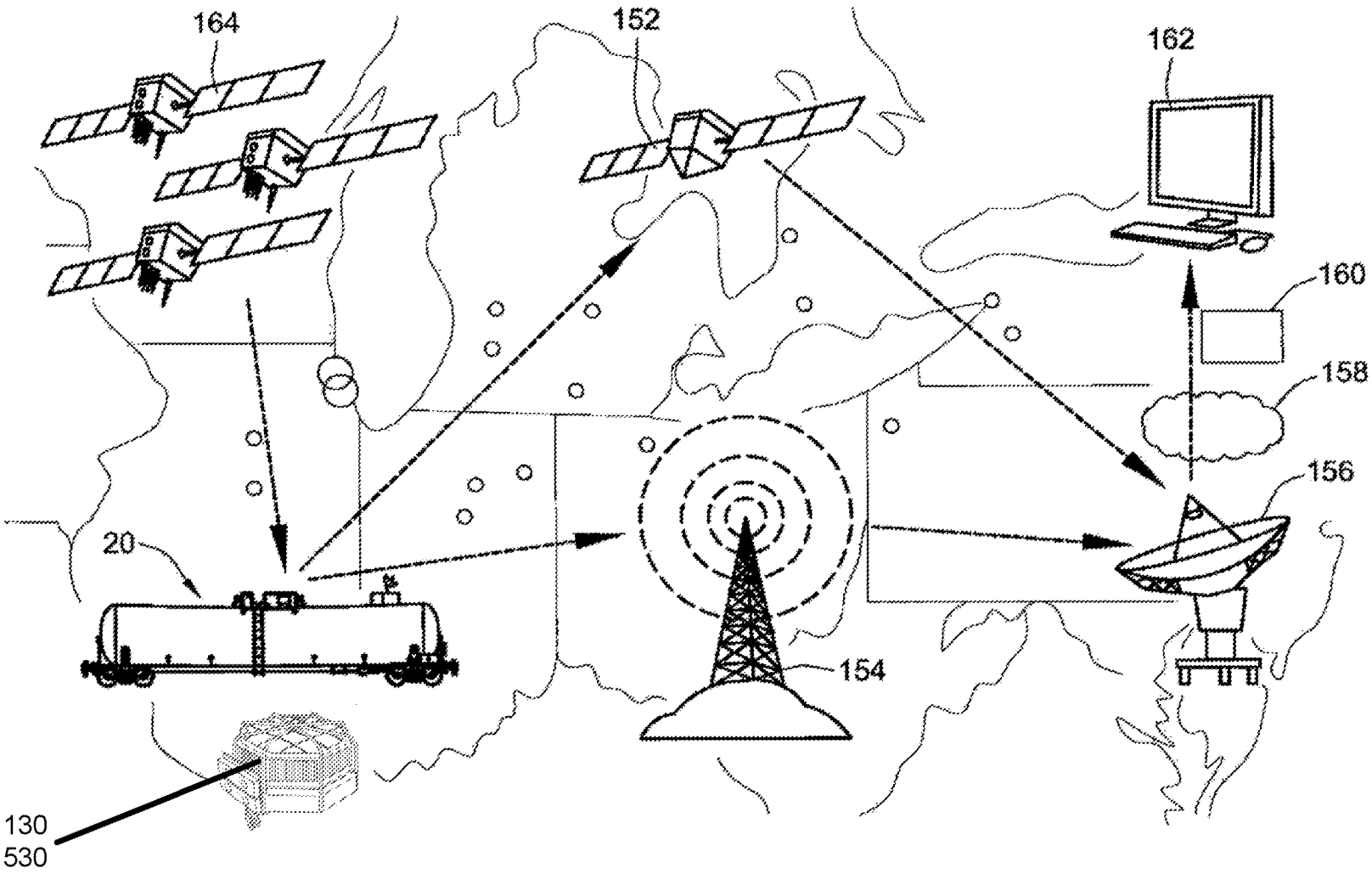
FIG. 8 is a flow diagram illustrating the data transmission and reception components in accordance with an embodiment of the system of the present invention.

FIG. 8 illustrates an embodiment for transmitting and receiving the data collected by the microprocessor 146, 546 from the derail warning system 100, 500 and derail warning light 130, 530 described above. It should be noted that the term "remote" as used herein means any location that is not on-board a rail car. Such a location may be any location of the derail warning system 100, 500.

As illustrated in FIG. 8, the data from the derail warning system 100, 500 and derail warning light 130, 530 may be transmitted to a geo-stationary communications satellite 152 and/or a cellular system 154 to one or more remote receiving station(s) 156. The receiving station 156 transmits the data via the Internet 158 to a web based portal 160 which is accessible by a user via a workstation 162. Data collected and transmitted can be from any derail warning system 100, 500. Location data may be generated by Global Positioning System (GPS) satellite technology 164. As was described above, the derail warning system 100, 500 and derail warning light 130, 530 may feature a number of additional data collection outputs. Outputs from all of the data from the derail warning system 100, 500 and derail warning light 130, 530 may be combined together to electronically represent the status or condition.

In an embodiment of the system, wireless sensors located at various locations throughout a rail yard may be set up in a wireless network with each sensor (node) having its own power source and transceiver. The nodes can communicate with other nodes and determine the best path of communication and minimize power requirements to reach the safest operation throughout the rail yard.

The derail warning system 100, 500 and derail warning light 130, 530 may also include a receiver/CPU and a GPS transponder which interacts with the U.S. Federal location satellites. This feature gives location, altitude, speed and other features offered by conventional GPS capabilities. The GPS and sensor data is then transmitted via a modem in the specified form of transmission along with the remaining railcar anti-collision data. Once the data is received by the end user, the data can be further combined for additional value. A preferred method to add value to data generated by the system is by associating the location data (GPS) with information stored in the on-board memory of microprocessor in the derail warning system 100, 500 and derail warning light 130, 530.

Once data is received by the end user (such as receiving station 156 or portal 160 in FIG. 8), it is loaded into a website or computer based software program capable of sorting, running calculations, manipulating and displaying data in formats that benefit the end user. The software may include a website which can display and run calculations to provide the needed information for the end user.

It is to be understood that the invention is not limited in its application to the details of construction and the arrangement of the components set forth herein. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

While the preferred embodiments of the invention have been shown and described, it will be apparent to those skilled in the art that changes and modifications may be made therein without departing from the spirit of the invention, the scope of which is defined by this description.

We claim:

1. A derail warning system for use on a rail, the derail warning system including:

a derail device that includes a mounting section that mounts to the rail and a rotatable base plate adjacent to the mounting section; and a portable derail warning light including a plurality of LEDs configured to turn on when the derail device is in a DERAIL position and turn off when the derail device is in a NON-DERAIL position, the derail warning light including a mounting device that attaches the derail warning light to the base plate of the derail device, wherein the derail warning light includes a microprocessor and an orientation sensor within the derail warning light, wherein the microprocessor includes data storage capabilities for time-stamping and data-logging the DERAIL positions and NON-DERAIL positions of the derail device, and wherein the orientation sensor senses the DERAIL position and the NON-DERAIL position and automatically turns on the derail warning light based on the DERAIL position of the derail device.

2. The derail warning system of claim 1, wherein the mounting section includes a pair of rotating brackets and a rotating pin to connect the base plate to the mounting section.

3. The derail warning system of claim 2, wherein the pair of rotating brackets and the rotating pin allow the base plate and the derail warning light to rotate from the NON-DERAIL position to the DERAIL position.

4. The derail warning system of claim 1, wherein the mounting device is a clamp to mechanically attach and connect the derail warning light to the base plate of the derail device.

5. The derail warning system of claim 4, wherein the clamp mechanically attaches to a handle along the base plate.

6. The derail warning system of claim 1, wherein the mounting device includes a magnet to magnetically attach and connect the derail warning light to the base plate of the derail device.

7. The derail warning system of claim 1, wherein the derail warning light includes a solar power panel within the derail warning light that provides power via solar energy to the derail warning light, the plurality of LEDs, the microprocessor, and the orientation sensor.

8. The derail warning system of claim 1, wherein the microprocessor is programmable to include data logging to record and log any and all data from the derail warning system, and further wherein the data logged is uploaded to be analyzed and reviewed.

9. The derail warning system of claim 1, wherein the plurality of LEDs are multi-colored arrangements to include blue, red, amber, white, and green.

10. The derail warning system of claim 1, wherein a first side of the mounting device faces upward when the base plate and the derail warning light are in the NON-DERAIL position, and wherein a second side of the mounting device opposite the first side faces upward when the base plate and the derail warning light are in the DERAIL position.

11. The derail warning system of claim 1, wherein the orientation sensor includes a tilt sensor.

12. The derail warning system of claim 1, wherein the orientation sensor includes a compass sensor.

13. The derail warning system of claim 1, wherein the plurality of LEDs are located around a periphery of the derail warning light.

14. A derail warning system for use on a rail, the derail warning system including:

a derail device that includes a mounting section that mounts to the rail and a rotatable base plate adjacent to the mounting section, the mounting section including a pair of rotating brackets and a rotating pin to connect the base plate to the mounting section; and a portable derail warning light including a plurality of LEDs configured to turn on when the derail device is in a DERAIL position and turn off when the derail device is in a NON-DERAIL position, the derail warning light including a mounting device that attaches the derail warning light to the base plate of the derail device, wherein the derail warning light includes a microprocessor, an orientation sensor, and a solar power panel within the derail warning light, wherein the microprocessor includes data storage capabilities for time-stamping and data-logging the DERAIL positions and NON-DERAIL positions of the derail device and the microprocessor is programmable to include data logging to record and log any and all data from the derail warning system, and wherein the data logged is uploaded to be analyzed and reviewed, wherein the solar power panel provides power via solar energy to the derail warning light, the plurality of LEDs, the microprocessor, and the orientation sensor, wherein the orientation sensor senses the DERAIL position and the NON-DERAIL position and automatically turns on the derail warning light based on the DERAIL position of the derail device, and wherein a first side of the mounting device faces upward when the base plate and the derail warning light are in the NON-DERAIL position, and wherein a second side of the mounting device opposite the first side faces upward when the base plate and the derail warning light are in the DERAIL position.

15. The derail warning system of claim 14, wherein the mounting device is a clamp to mechanically attach and connect the derail warning light to a handle along the base plate.

16. The derail warning system of claim 14, wherein the plurality of LEDs are located around a periphery of the derail warning light.

17. A derail warning system for use on a rail, the derail warning system including:

a derail device that includes a mounting section that mounts to the rail and a rotatable base plate adjacent to the mounting section, the mounting section including a pair of rotating brackets and a rotating pin to connect the base plate to the mounting section; and a portable derail warning light including a plurality of LEDs configured to turn on when the derail device is in a DERAIL position and turn off when the derail device is in a NON-DERAIL position, the derail warning light including a mounting device that attaches the derail warning light to the base plate of the derail device, wherein the derail warning light includes a microprocessor and an orientation sensor within the derail warning light, wherein the microprocessor includes data storage capabilities for time-stamping and data-logging the DERAIL positions and NON-DERAIL positions of the derail device, and further wherein the orientation sensor senses the DERAIL position and the NON-DERAIL position and automatically turns on the derail warning light based on the DERAIL position of the derail device, wherein the orientation sensor comprises a tile sensor or a compass sensor, and wherein a first side of the mounting device faces upward when the base plate and the derail warning light are in the NON-DERAIL position, and wherein a second side of the mounting device opposite the first side faces upward when the base plate and the derail warning light are in the DERAIL position.

18. The derail warning system of claim 17, wherein the mounting device is a clamp to mechanically attach and connect the derail warning light to a handle along the base plate.

19. The derail warning system of claim 17, wherein the plurality of LEDs are located around a periphery of the derail warning light.

20. The derail warning system of claim 1, wherein the microprocessor and the orientation sensor are accessible via an access door in a base of the derail warning light.

* * * * *